US007824309B1

(12) United States Patent
Tadlock

(10) Patent No.: US 7,824,309 B1
(45) Date of Patent: Nov. 2, 2010

(54) METHOD AND APPARATUS FOR PACING HUMAN BODY EXERCISES USING AUDIBLE CUES

(76) Inventor: Thomas L. Tadlock, 16822 Bayview Dr., Huntington Beach, CA (US) 92649

( * ) Notice: Subject to any disclaimer, the term of this patent is extended or adjusted under 35 U.S.C. 154(b) by 0 days.

(21) Appl. No.: 12/231,280

(22) Filed: Sep. 2, 2008

(51) Int. Cl.
*A63B 71/00* (2006.01)

(52) U.S. Cl. ..... 482/3; 482/1

(58) Field of Classification Search ..... 482/1, 482/3, 8, 9

See application file for complete search history.

(56) References Cited

U.S. PATENT DOCUMENTS

| | | | | | |
|---|---|---|---|---|---|
| 3,492,582 | A * | 1/1970 | Heywood | 340/323 R |
| 3,995,492 | A * | 12/1976 | Clynes | 73/379.01 |
| 4,099,713 | A * | 7/1978 | Spector | 482/3 |
| 4,285,041 | A * | 8/1981 | Smith | 482/3 |
| 4,413,821 | A * | 11/1983 | Centafanti | 482/3 |
| 4,510,485 | A * | 4/1985 | Tahara | 340/323 R |
| 4,571,680 | A * | 2/1986 | Wu | 377/24.2 |
| 4,728,100 | A * | 3/1988 | Smith | 482/3 |
| 4,776,323 | A * | 10/1988 | Spector | 601/23 |
| 4,813,665 | A * | 3/1989 | Carr | 482/3 |
| 5,286,244 | A * | 2/1994 | Wright et al. | 482/108 |
| 5,451,922 | A * | 9/1995 | Hamilton | 340/309.16 |
| 5,516,334 | A * | 5/1996 | Easton | 482/8 |
| 5,526,290 | A * | 6/1996 | Kanzaki | 702/160 |
| 5,830,107 | A * | 11/1998 | Brigliadoro | 482/1 |
| 5,921,890 | A * | 7/1999 | Miley | 482/3 |
| 6,045,364 | A * | 4/2000 | Dugan et al. | 434/252 |
| 6,409,636 | B1 * | 6/2002 | Risso et al. | 482/82 |
| 6,700,499 | B2 * | 3/2004 | Kubo et al. | 340/686.1 |
| 6,837,827 | B1 * | 1/2005 | Lee et al. | 482/8 |
| 7,455,621 | B1 * | 11/2008 | Anthony | 482/8 |
| 7,470,216 | B2 * | 12/2008 | Farinelli et al. | 482/3 |
| 2003/0171189 | A1 * | 9/2003 | Kaufman | 482/8 |
| 2005/0209053 | A1 * | 9/2005 | Knox | 482/27 |
| 2005/0233859 | A1 * | 10/2005 | Takai et al. | 482/3 |

FOREIGN PATENT DOCUMENTS

GB 2175508 A * 12/1986

* cited by examiner

*Primary Examiner*—Nicholas D Lucchesi
*Assistant Examiner*—Sundhara M Ganesan
(74) *Attorney, Agent, or Firm*—William L. Chapin

(57) ABSTRACT

A method and apparatus for pacing human exercises includes a sequence of pre-recorded, repetitive humanly perceptible signals in which a first, accented signal pulse, such as the first beat in a four-four measure of musical time, establishes a repetitive rhythmic tempo to thus provide timing track signal for synchronizing various phases of an exercise. The rhythmic pulses, which are preferably provided by a percussion instrument such as a drum and accompanied by musical tones, are accompanied by instructions verbalized by an exercise trainer in synchronization with the timing track signal. The perceptible signals are preferably audible and are optionally accompanied by or replaced by visibly perceptible signals such as flashing lights.

38 Claims, 4 Drawing Sheets

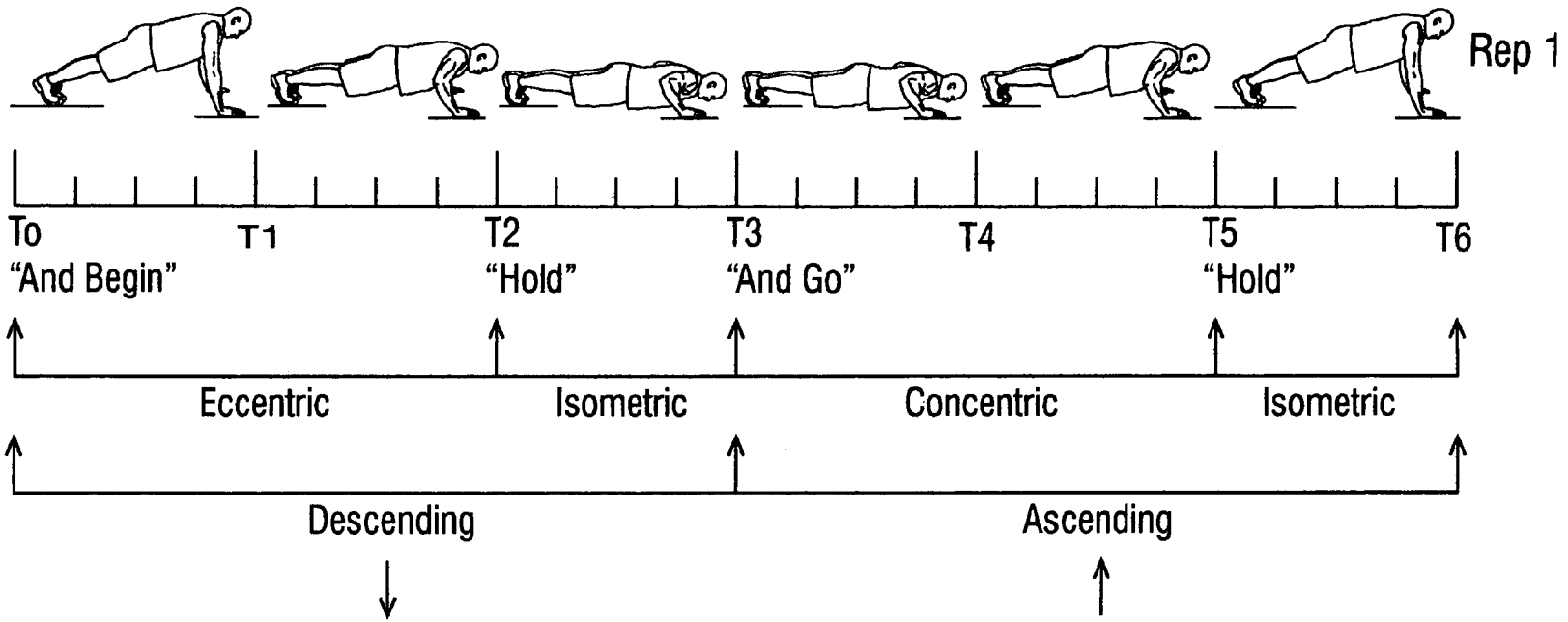
*Fig. 2, Push ups*

*Fig. 3, Bilateral cable curls*
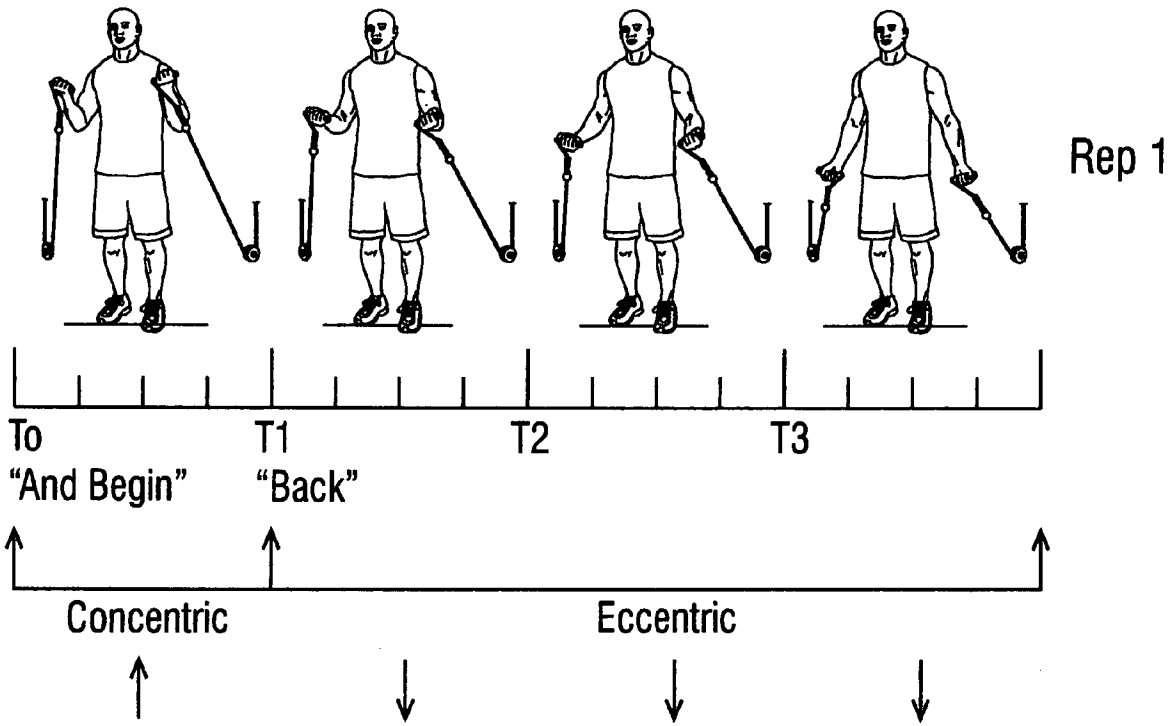

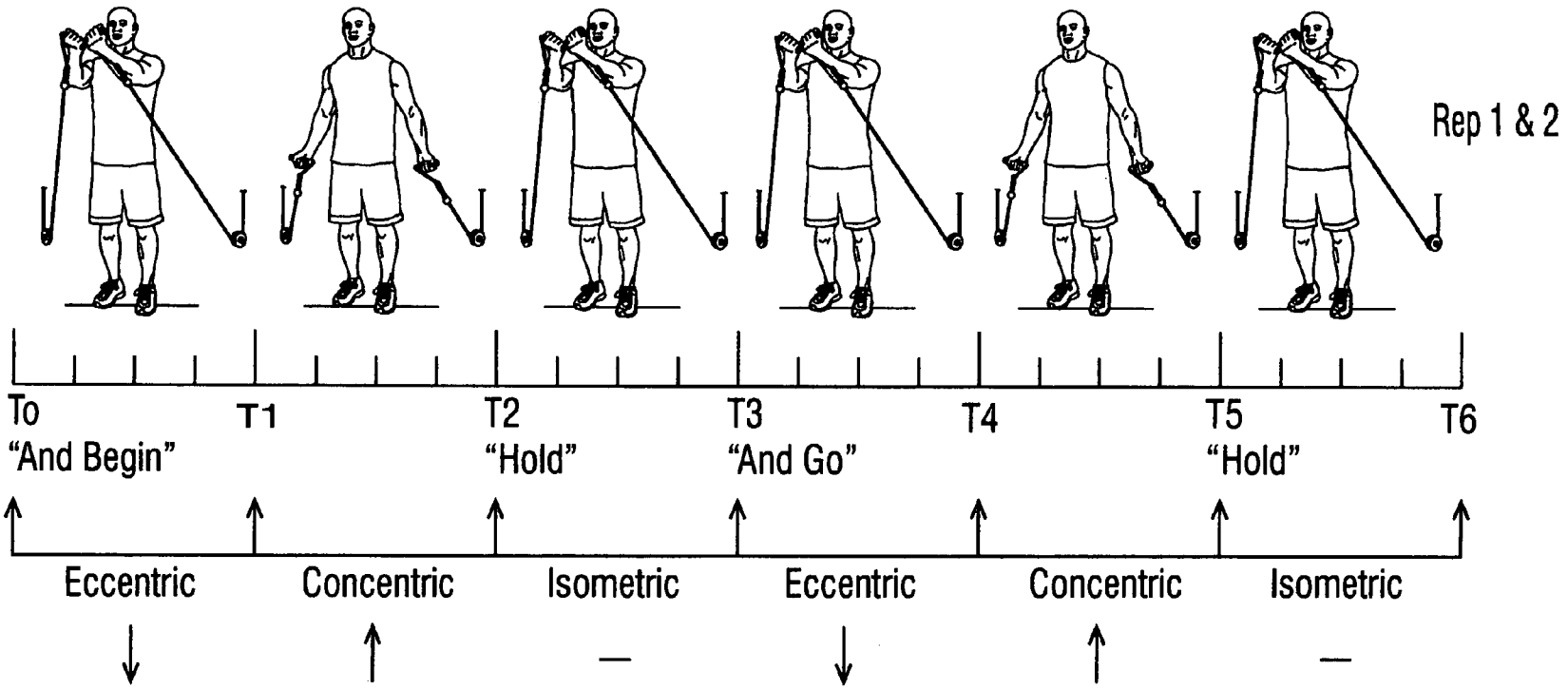
*Fig. 4, Low-to-high-cable fly*

METHOD AND APPARATUS FOR PACING HUMAN BODY EXERCISES USING AUDIBLE CUES

BACKGROUND OF THE INVENTION

A. Field of the Invention

The present invention relates to physical exercises performed by a human to improve and/or maintain fitness, wellness or athletic ability. More particularly, the invention relates to a method and apparatus for pacing human body exercises by synchronizing exercise motions to audible cues.

B. Description of Background Art

The importance of physical exercise to the health of an individual is well established. It is known that regular exercise of the proper kind strengthens the cardio-vascular system of a person in addition to strengthening the muscles. Also, regular exercise improves the overall appearance and self-image of an individual, and therefore can have a beneficial effect upon his or her mental health. From a purely economic standpoint, employers have found it desirable to encourage the physical fitness of their employees. Resistance to disease, decreased absenteeism and an overall increase in productivity have been observed among employees who keep fit. Regular exercise is an important part of any physical fitness regimen.

Walking, jogging and swimming, to name just a few popular physical activities, are all good exercises. However, because of constraints imposed upon an individual because of limitations on available time, or because of the physical location of his or her workplace, it is often inconvenient for him or her to partake as often as might be desired in beneficial exercises of the type listed above. Also, some exercises such as the type performed by weight lifters or athletes require the utilization of various types of equipment such as weights and/or springs to provide a resistance force to movements of the body.

For those reasons, a growing number of people utilize commercially operated gymnasiums or fitness centers to obtain their needed exercises. Such facilities usually have are re-configurable to enable performance of a variety of exercises using a machine, such as a dual adjustable pulley machine sold by Star Trac, Inc., 14410 Myford Road, Irvine, Calif. 92606

An important advantage offered by gymnasiums and fitness training centers is the availability of knowledgeable trainers to assist clients with their exercises. Trainers are familiar with the proper use of the various items of exercise equipment available at their respective facilities, and thus able to advise their clients on how best to safely and effectively use that equipment. Of equal importance, some trainers, such as those who have graduate degrees in exercise physiology, are qualified to establish fitness regimens to suit the goals of a particular client. Such fitness regimens can include diet recommendations, but will also include an outline of specific exercise sequences or workouts which the client should regularly perform to achieve a desired result, such as muscle toning, fat loss, or strength and endurance augmentation.

Most human physical exercises which are intended to improve or maintain wellness, fitness, strength or endurance involve repetitive motions. Usually such exercises involve resistance forces which oppose the motions of body members. A simple example is a push-up exercise, in which the force of gravity acting on a person's body weight provides a resistance force to elevating the upper part of the body. Other resistance exercises, such as a cable row, may include cyclically pulling and releasing a handle which is attached to a cord which is looped over a pulley to elevate weights, a spring, or other such apparatus which provides a fixed or variable resistance force, a predetermined number of times. An exercise set typically consists of a predetermined number of pull and release cycles. A workout consists of a predetermined number of sets, interspersed with rest periods of a predetermined duration.

A typical exercise regimen for a gymnasium client can include a sequentially performed series of different exercises, such as push-ups, barbell arm curls, leg weight lifts, etc. Moreover, when as is typical, multiple clients are simultaneously exercising at a gymnasium, the clients may be simultaneously performing different exercises on different machines, or using different equipment.

Repetitive exercises typically include three distinct phases identified by exercise physiologists. The phases includes a first, "eccentric" phase in which the prime mover muscles, i.e., master muscles which are primarily responsible for producing an intended motion, lengthen under an externally applied tension or load. The second "isometric" phase of an exercise consists of a pause at the end of the eccentric phase. The third, last phase of an exercise, in which the prime mover muscles are contracted and shortened by the person exercising, is referred to as the "concentric" phase.

It has been found that repetitive exercises routines are most effective when the rates at which body parts are cyclically moved are reasonably precisely timed. However, it has also been found that human perception of the time durations of various phases of typical resistance exercises is rather poor. For example, it is a common tendency for a person performing repetitive pulling exercise cycles to perceive the time duration of the concentric phase of a cycle in which substantial muscle tension is required, to be longer than a muscle relaxation (eccentric) portion of the cycle, even though the time intervals might be the same. Therefore, it would be desirable to provide precise timing cues to a person performing a repetitive exercise, so that the duration of each phase of the exercise, as well as the repetition frequency of each complete exercise cycle in a set, are both maintained at predetermined, constant time durations.

The duration of each phase of an exercise, and the repetition frequency or tempo of the exercise may be controlled by a personal trainer, exercise physiologist or other such qualified person who can provide voice directions or cues to a client and thus pace the timing of the client's exercise movements. Sometimes the trainer may use a stop watch to guide the timing of his voice cues. However, providing pacing cues can sometimes distract a trainer from his or her observations of a client's exercise motions, and from giving corrective instructions to the client during an exercise. Therefore, it is very difficult for a trainer to issue pacing cues at a constant tempo while simultaneously observing and giving corrective instructions to an individual. Also, since an individual trainer may direct multiple clients who are simultaneously performing different exercises, it is usually not possible for a trainer using existing methods to provide constant-tempo cues while simultaneously directing and observing the multiple individual clients, especially when they are performing different exercises.

The present invention was conceived of to provide a method and apparatus for pacing repetitive human physical exercises which offers a solution to the above-mentioned problems of pacing such exercises.

OBJECTS OF THE INVENTION

An object of the present invention is to provide a method and apparatus for pacing repetitive physical exercises to synchronize the exercises to predetermined time periods.

Another object of the invention is to provide a method and apparatus for pacing human exercises which includes providing audible cues to synchronize the timing of individual phases or steps, repetition frequency, and number of cyclical repetitions of an exercise, and the duration of rest periods between individual cycles and/or sets of cycles.

Another object of the invention is to provide a method and apparatus for providing timing control of human physiological exercises using voice commands synchronized with repetitive sounds.

Another object of the invention is to provide a method and apparatus for pacing human exercises synchronized with rhythmic musical sounds which establish a tempo, and voice-over commands superimposed on the musical rhythm sounds which verbally direct various steps of an exercise, at an integral sub-frequency of the rhythm.

Another object of the invention is to provide a method and apparatus for audibly pacing human physiological exercises using a plurality of pre-recorded musical rhythm sounds with superimposed voice command cues, including a variety of rhythm and voice commands suitable for simultaneously pacing different exercises simultaneously performed by different individuals. Various other objects and advantages of the present invention, and its most novel features, will become apparent to those skilled in the art by perusing the accompanying specification, drawings and claims.

It is to be understood that although the invention disclosed herein is fully capable of achieving the objects and providing the advantages described, the characteristics of the invention described herein are merely illustrative of the preferred embodiments. Accordingly, I do not intend that the scope of my exclusive rights and privileges in the invention be limited to details of the embodiments described. I do intend that equivalents, adaptations and modifications of the invention reasonably inferable from the description contained herein be included within the scope of the invention as defined by the appended claims.

SUMMARY OF THE INVENTION

Briefly stated, the present invention comprehends a method and apparatus for improving the effectiveness of physical exercises performed by a person for the purpose of improving or maintaining physical fitness. According to the invention, a method and apparatus are provided in which a sequence of pre-recorded audible cues are transmitted to one or more persons engaging in differing exercises, to thereby properly pace the exercises.

In accordance with the invention, an apparatus such as an audio tape player, CD player, MP3 player, IPOD or other such device capable of producing audible and/or visible images of pre-recorded material is provided which emits pre-recorded audible sounds. The sounds are emitted at a constant audible tempo established, for example, by a percussion musical instrument such as a drum, in which time frames corresponding to musical measures are established by an accented drum beat, such as the accented first beat of each measure of a four-four time rhythm. The percussion sounds are preferably accompanied by musical tones produced by a human voice, conventional musical instruments, or an electronic synthesizer.

According to the invention, a recorded natural or synthesized voice issues verbal messages which are synchronized with the repetitive drum beats or other periodic sounds, which thus act as a constant frequency-setting or tempo-setting audible timing clock track.

The verbal messages serve as cues or directions to a person to sequentially perform different phases of an exercise sequence or routine.

For example, a cyclic repetition of pulling a weight against a resisting force such as a spring or a cable connected to a dead weight looped around a pulley and releasing the weight may be synchronized with constant tempo sounds emitted in a 2-1-2 rhythm pattern, wherein the voice command "Hold" "and Go" are contained in a one-second interval, followed by a two-second pause, and a repetition of the words "Hold" and Go" to complete one cycle of a sequence of cycles at a 2-1-2 rhythmic tempo.

The present inventor has found that voice cues such as those stated above, when synchronized with rhythmic musical and/or percussion sounds, greatly facilitate repetitive exercise movements. Importantly, commands such as "hold and go" "now drive," "back," and the like can be used to simultaneously cue different exercise motions. The exercise set can include exercises such as push-ups or other such body weight exercises, and stretching exercises which are performed using resistance machines, or other types of exercises performed on similar or different machines. Consequently, the voice of a single trainer, whether live or pre-recorded, in synchronization with a tempo established by percussion sounds and optional musical tone sequences broadcast at a given tempo, may effectively pace the exercises of multiple clients performing the same or different routines on similar or different machines at a gymnasium or other training site.

According to the invention, a repetitive sequence of sounds, such as drum beats, which are repeated at a constant frequency functions as an audible timing clock signal. Typically, the clock signals are emitted at a frequency or tempo of greater than one pulse or beat per second, such as a fast 4-4 time rhythm in which there are four beats per second, with the first beat accented, i.e., each sequence of four beats constitutes one measure of a four-four time rhythm, and corresponds to a time frame having a one-second duration.

Since individual steps or phases of most exercises are performed over an interval of 1 second or greater, the actual tempo of exercises performed in synchronization with the time clock tones, e.g., drum beats, are performed at a frequency which is lower than that of the drumbeat.

In other words, the frequency or tempo of motions of an exercise paced by the method of the present invention will be an integral sub-harmonic of the drum-beat tempo. For example, a repetitive weight pulling exercise sequence performed at a 2-1-2 rhythmic tempo could consist of pulling a handle to extend a cable a predetermined limit distance against a resistance force provided by a weight or spring, over a 2-second interval, pausing at the end of the pull extension limit for 1 second, and then relaxing muscle tension to release the cable and allow it to retract over a 2-second return interval.

The foregoing motions are performed in synchronization with voice cues such as "Hold," 1-second pause, "And Go," 2-second pause, repeated, for example 10 times.

Since the rhythmic drum beats occur at a frequency four times that of various body motions, precise synchronization of the voice cues and motions is facilitated. This is because both voice cues and exercise motions are provided with multiple count-down sound pulses, e.g., 3 pulses, when the sound pulses occur at a frequency of four beats per second, for exercises in which individual phases of a cycle of the exercise have a minimum time interval of one second.

BRIEF DESCRIPTION OF THE DRAWINGS

FIG. 2 is a diagrammatic view showing movements of a person performing a push-up exercise sequence in synchronization with the audible signals broadcast in accordance with the 2-1-2 rhythmic tempo of FIG. 1.

FIG. 3 is a diagrammatic view showing movements of a person performing a bilateral cable curl exercise routine in synchronization with the audible signals broadcast in accordance with 3-0-1 rhythmic tempo.

FIG. 4 is a diagrammatic view showing movements of a person performing a low-to-high cable fly exercise in synchronization with audible signals broadcast in accordance with a 1-1-1 rhythmic tempo.

DESCRIPTION OF THE PREFERRED EMBODIMENTS

Figure 1:
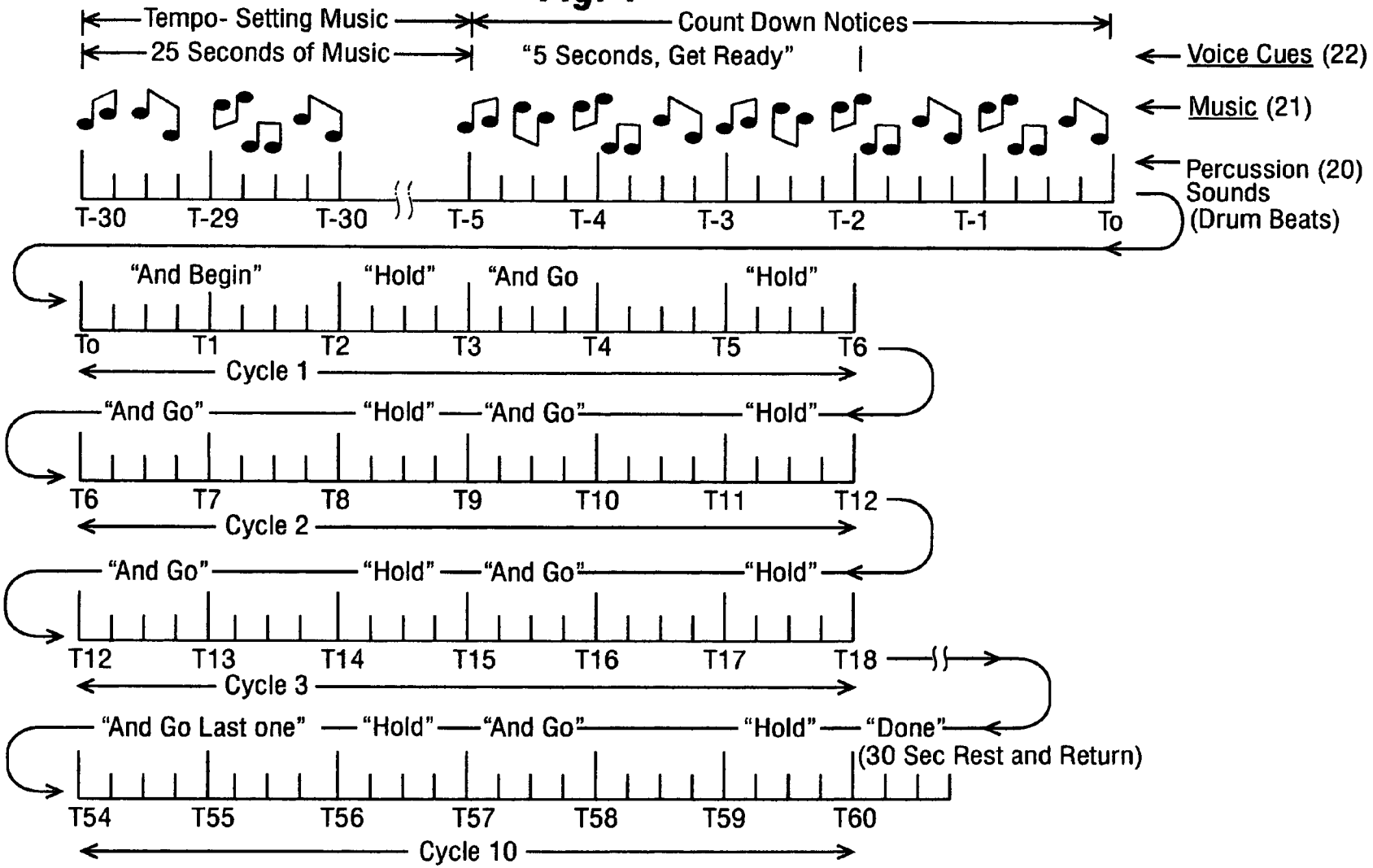
FIG. 1 is a timing diagram showing time relationships between a musical sound track having audible timing clock signals established by drumbeats, accompanying music, and voice cues superimposed on the music sound track for pacing exercise sequences performable in synchronization with a 2-1-2 rhythmic tempo, 10 repetition cycles or sets, and a 30-second rest period.

FIGS. 1-4 illustrate various aspects of a method and apparatus for pacing human body exercises using audible cues according to the present invention. According to the invention audible verbal messages are emitted in synchronization with rhythmic musical sounds which establish a particular rhythm at a constant frequency or tempo. Consequently, the mechanical implementation of the invention may utilize any suitable apparatus and platform for broadcasting audio sounds, such as an audio tape player, CD player, MP3 player, computer with output loudspeakers, etc.

FIGS. 1 and 2 illustrate a basic embodiment of a method for pacing human body exercises using audible cues according to the present invention. In the example basic embodiment of the invention depicted in those figures, the audible signals depicted in diagrammatic form in FIG. 1 are recorded on an analog audio recording medium such as an audio tape, or a digital medium such as a CD Rom, MP3 memory unit, or any other suitable recording medium.

As shown in FIG. 1, a sequence of sounds such as drumbeats which are continuously repeated are recorded on an audio recording track of one of the recording media listed above, or any other suitable media capable of recording with reasonable fidelity signals within the range of human audibility, i.e., 20 HZ-20 KHZ. Although the selected medium preferably has a record and playback bandwidth which is a significant fraction of the 20 HZ-20 KHZ audible bandwidth, for the purposes of the present invention that bandwidth be substantially less. For example, a bandwidth of 300 HZ to 3 KHZ which is used in many telephone systems and found adequate to transmit voice conversations with reasonable fidelity, is considered adequate for the purposes of the present invention.

As shown in FIG. 1, a first audio track 20 consists of a sequence of sounds such as percussion sounds produced by beats on a snare drum, a bass drum, triangle, or other such musical percussion instrument. As shown in the figure, the percussion sounds of track 20 are repeated at a constant frequency, or tempo, and serve as an audible time clock signal. That frequency preferably should be at least as high as the maximum repetition frequency of any phase of an exercise which the track is intended to be used with.

In other words, if the minimum time interval between any phase of an exercise, such as the interval between the beginning and ending of a muscular contraction of a concentric phase is 1 second, the frequency of time clock pulses of track 20 should be at least 1 HZ, corresponding to a time clock period of 1 second. Desirably, however, the frequency of time pulses of clock track 20 should be greater than the maximum frequency of any phase of an exercise. Thus, in the example of FIG. 1, the frequency of the drum beats which constitute the time clock pulses of time track 20, is 4 beats or pulses per second.

It is desirable to provide an audible time clock having a frequency greater than the frequency of any phase of an exercise phase because doing so affords more precise timing of actions synchronized with the time clock pulses. Thus, a person listening to a sequence of audible clock signal tones that are broadcast at a constant frequency of one cycle per second can usually synchronize his or her body motions to within a fraction of a second. However, a person who either consciously or subconsciously perceives beats emitted at a higher frequency, e.g., four-pulses per second, is provided with what amounts to three count-down beats spaced at ¼ second intervals. Perception of such count-down beats enables a person to more precisely synchronize motions to a smaller fraction of a second than possible using a one pulse per second clock rate.

Referring still to FIG. 1, it may be seen that the method of the present invention preferably includes a track 21 of recorded music which is synchronized with percussion sounds of track 20. Of course, both percussion and musical sounds may optionally be recorded on a single track of a recording medium, or separate or multiple tracks to produce stereophonic or quadraphonic sound reproductions. Therefore, it can be readily appreciated that percussion sound clock track 20, and music track 21 need not be physically separate parts of a recording media, and are separately identified in FIG. 1 and the ensuing description merely for the sake of clarity.

Referring still to FIG. 1, it may be seen that the method of the present invention includes a third "track" 22, which contains verbal instructions, i.e., voice cues, for guiding a person in performing various exercise motions. For the reasons stated above, voice-over track 22 need not be recorded in a physically separate location of a recording medium, but in fact can be "mixed" with percussion sounds of clock track 20 and musical tones of music track 21. Also, the audible verbal instructions of track 22 may optionally be produced by a voice synthesizer. In fact, sounds represented by all three tracks 20, 21 and 22 may optionally be produced by a computer program running on an application-specific platform, personal computer or the like, which has an audio frequency output signal that is output to loudspeakers, or used to modulate RF or infrared carrier signals receivable by a person wearing a suitable receiver, demodulator and earphones or loudspeaker.

According to another variation of the invention, a facility may be provided for suppressing the voice-over track, enabling a live instructor to verbalize in real time appropriate exercise pacing instructions in synchronization with sounds produced by recorded percussion track 20 and music track 21.

The example embodiment of the method of the present invention depicted in diagrammatically in FIG. 1 incorporates, one of a number of different rhythm patterns which are suitable for different exercises.

Following a standard nomenclature for exercise timing patterns used by exercise physiologists, an exercise timing pattern is identified by a sequence of numbers q-r-s, where q represents the relative duration of an eccentric phase, r represents the relative duration of an isometric phase and s represents the relative duration of an concentric phase. Thus, for example, an exercise synchronized with a 2-1-2 rhythmic tempo may have a 2-second long eccentric phase, a one-second long isometric phase, and a two-second long concentric phase. (The identical rhythm pattern, but at a tempo twice as fast, would halve the duration of each of the foregoing phase durations).

For exercise timing patterns which do not include an isometric phase, the timing patterns would be designated by the numbers q-r-s, as, for example, 3-0-1.

Referring again to FIG. 1, the figure depicts an exercise pacing time schedule or pattern which employs a 2-1-2 rhythmic tempo, and includes 10 repetitions of a particular exercise, interspersed with a 30-second rest period. That time schedule is suitable for pacing a variety of exercises, including the following:

Exercise Sequence 1: (2-1-2) Rhythmic Tempo, 30 Second Rest Period

1. R (Right) Track Stretch (lengthen hamstrings, strengthen quads).
2. R Single Leg Deadlift (strengthen hamstrings and glutes, increase balance and core stability).
3. L Track Stretch (lengthen hamstrings, strengthen quads).
4. L Single Leg Deadlift (strengthen hamstrings and glutes, increase balance and core stability).
5. R Leg Back Lunge (strengthen legs, glutes & upper body, lengthen hip flexors).
6. L Leg Back Lunge (strengthen legs, glutes & upper body, lengthen hip flexors).
7. Squat Curl Band Press (strengthen total body).
8. Prone Military Press w/Band (strengthen entire back, triceps, and shoulders, lengthen pecs & shoulders).
9. Push-up.

An exercise from the foregoing list, such as exercise #9, Push-up, may be paced by the method of the present invention, as follows.

Referring to FIG. 1, an audible cuing method for pacing exercise #1 preferably includes initially broadcasting audible signals including percussion sounds accompanied by music for a short count-down period, of say, 30 seconds. Thus, as depicted in track 20 of per second is broadcast beginning at time T-30 (T-30 seconds), and accompanied by musical notes as depicted by track 22.

As indicated diagrammatically in FIG. 1, the sequence of drum beats of clock track 20 preferably include accented, larger amplitude beats which occur at a regular frequency which is an integral sub-harmonic of the basic beat frequency. Thus, as shown in FIG. 1, the first beat of each group of four beats has a greater amplitude than the remaining three beats, as signified by the greater height of the vertical line representing the beat. The accented beat, for example, could correspond to the first beat in a musical measure of fast ¾ time.

After 25 seconds of drum beats, at T-5, a verbal message in voice-over track 22 is emitted, which states, "5 Seconds, Get Ready." After 30 seconds, at a time identified as T0, a voice-over message announces, "And Begin," that message being broadcast during a two-second interval between T0 and T2. During the 1-second long time interval between T2 and T3, voice-over track 22 broadcasts the message, "Hold." At time T3, the message, "And Go" is once again broadcast from track 22. At time T5 another 'Hold" is broadcast, completing a first cycle of a (2-1-2) rhythm sequence of voice directions.

A predetermined additional number of (2-1-2) tempo cycles is broadcast by tracks 20, 21 and 22. Thus, as shown in FIG. 1, a total of (10) (2-1-2) tempo cycles is broadcast, ending at time T30. Also at T30, a rest period of a predetermined duration is cued by the voice message, "And Done." As is also shown in FIG. 1, a person performing exercises cued as described is given advance notice of a forthcoming rest period by a voice message such as, "Five More Reps To Go" occurring 5 cycles before beginning of the rest period.

The rest period, which begins at time T30, or at any, other clock time corresponding to a predetermined number of completed exercise cycles or repetitions, may be for any predetermined time period, such as 30 seconds.

At the end of the rest period, the above-described sequence may be repeated, either by playing additional sequences of recorded tracks, or tracks of a streaming media, or by looping the contents of a media recording corresponding to a complete sequence of exercise cycles and rest period(s).

FIG. 2 is a diagrammatic view showing movements of a person performing a push-up exercise paced by the sequence of audio cues diagramed in FIG. 1 and described above. Referring to FIG. 1 and FIG. 2, a first, descending (eccentric) phase of a first cycle of a push-up exercise is cued by a voice instruction stating "And Begin" and drum beats during a two-second interval beginning at time T0 and ending at time T2. The descending (eccentric) phase has a 2-second time duration coincident with the time interval beginning at time T0 and ending at T2.

As shown in FIG. 2, a second, isometric phase of the first cycle of the exercise is cued by the voice instruction "Hold," and drum beats occurring during a one-second long time interval beginning at time T2 and ending at time T3, corresponding to a pause in the push-up exercise.

At time T3, a third, ascending (concentric) phase of the push-up exercise sequence is cued by the voice instruction stating "And Go." The ascending (concentric) phase has a 2-second time duration coincident with the time interval beginning at time T3 and ending at time T5. At T5, a voice instruction stating "Hold" is emitted, initiating a final isometric phase which continues until T6, thus completing a first cycle of the exercise routine.

The foregoing motions shown in FIG. 2 are repeated for a predetermined number of repetitions or cycles, such as 10 cycles, until the voice command, "Hold" is issued at T59. Issuance of an "And Done" command at T60 signifies the end of the 10-cycle exercise set.

FIG. 3 is a diagrammatic view showing movements of a person performing a second, bilateral cable curl exercise. According to the invention, that exercise is paced by a sequence of audio cues which are similar to those diagramed in FIG. 1 and described above. However, the musical tones and accompanying voice instruction used to pace the bilateral cable curl exercise are synchronized with a 3-0-1 rhythmic tempo rather than a 2-1-2 rhythmic tempo depicted in FIG. 1. In this exercise, as well as others, the three numbers designating a rhythmic tempo represent the relative time durations of the three different types of muscle movements which are sequentially performed during an exercise. Thus, a 2-1-2 rhythmic tempo represents a 2-second (or other time interval such as a fraction of a second) long (eccentric) muscle action, followed by a first 1-second long isometric phase, a 2-second concentric phase and a second 1-second isometric phase.

For an exercise which is performed in synchronization with a 3-0-1 rhythmic tempo such as the bilateral cable curl depicted in FIG. 3, the 0 indicates that there is no isometric phase in the routine. Thus, as shown in FIG. 3, the bilateral cable curl exercise begins with a 1-second long concentric phase, followed immediately by a 3-second long eccentric phase. It should be noted that the q-r-s designation at an exercise temp indicates merely the duration of the eccentric, isometric and concentric phases of an exercise. Thus, according to that nomenclature, an exercise routine synchronized with a 3-0-1 rhythmic tempo could begin with a 3-second long eccentric phase, followed by a zero duration isometric phase and completed by a 1-second concentric phase. Alternatively, as shown in FIG. 3, the exercise could begin with a 1-second concentric phase followed by a zero-duration isometric phase, and completed by a 3-second long eccentric phase.

FIG. 4 depicts a third, low-to-high cable fly exercise. According to the invention, that set is paced by a sequence of audio cues which are similar to those diagramed in FIG. 1 and described above. However, the musical tones and accompanying voice instructions used to pace the low-to-high cable fly exercise are synchronized with a 1-1-1 rhythmic tempo rather than a 2-1-2 rhythmic tempo. Thus, as shown in FIG. 4, the low-to-high cable fly exercise is synchronized with pacing cues emitted at a 1-1-1 rhythmic tempo, and include for each cycle of the set a sequence including a 1-second long eccentric phase, 1-second long isometric phase, 1-second long concentric phase.

According to the invention, other exercises in addition to the three examples described above may be effectively paced, using one of the three rhythmic tempos described above, or using different rhythmic tempos. Also, the frequency or tempo of the rhythms may optionally be increased or decreased.

An apparatus according to the present invention comprises a device which is programmed to emit audible cues in accordance with the above-described pacing methods. Thus, an apparatus according to the present invention includes a device such as a tape player, CD player, MP3 player, IPOD, computer or the like in which is embedded, pre-recorded or programmed a sequence of audible signals such as percussion sounds, music and voice commands which are synchronized in the manner shown in FIG. 1 and described above. Although the preferred embodiment of the method and apparatus according to the present invention uses audible cues, some or all of the audible cues may be replaced or accompanied by other humanly perceptible signals, such as lights, visual images, pager-type vibrations coupled to the body, etc.

What is claimed is:

1. A method for pacing human physical exercises performed cyclically at an exercise cycle rate by stimulating a physiological response in a human being, said method comprising utilizing an audio playback device to;

a. provide a first audible rhythmic clock signal at a first frequency, higher than an exercise cycle rate, b. provide simultaneously with said first clock signal a second audible exercise phase cuing signal containing cues for pacing sequential phases of an exercise cycle, said second phase cuing signal being at a second frequency and synchronized with said first clock signal, and c. said first and second signals being autonomously and automatically provided independently of any external influence.

2. The method of claim 1 wherein said first audible clock signal is further defined as being cyclically repeated.

3. The method of claim 1 wherein said first frequency is constant.

4. The method of claim 1 wherein at least one of said first and second audible signals is accompanied by a visually perceptible signal.

5. The method of claim 1 wherein said first signal includes a sequence of time intervals, each of said intervals containing a first perceptibly accented signal pulse followed by a predetermined number of unaccented signal pulses.

6. The method of claim 1 wherein said first audible signal includes percussion musical instrument sounds.

7. The method of claim 6 further including providing a third audible signal synchronously with said first audible signal, said third audible signal containing musical sounds.

8. The method of claim 1 wherein said second, audible cuing signal includes a verbal instruction.

9. The method of claim 8 wherein said second, audible cuing signal is cyclically repeated at a sub-harmonic of said first frequency.

10. The method of claim 8 wherein said verbal instruction include exercise initiation cues indicating the beginning of an exercise.

11. The method of claim 10 wherein said verbal instruction include a cyclically repeated sequence of exercise phase directions.

12. The method of claim 11 wherein said verbal instruction include exercise cessation signals indicating the completion of a pre-determined number of cyclically repeated phases of an exercise.

13. The method of claim 1 wherein said first frequency is higher than said second frequency.

14. The method of claim 13 wherein the first frequency is greater than one cycle per second.

15. An apparatus for pacing human physical exercises performed cyclically at an exercise rate by stimulating a physiological response in a human being, said apparatus comprising;

a. pre-recorded medium containing, i. a first recorded audible rhythmic clock signal at a first frequency higher than an exercise cycle rate, and ii. a second recorded audible exercise phase cuing signal containing cues for pacing sequential phases of an exercise cycle, said second signal being synchronized with said first signal, and b. a playback transducer device for emitting in response to said first and second recorded signals to first and second audible signals, said first and second audible signals being emitted simultaneously and independently of any influence external to said playback transducer.

16. The apparatus of claim 15 wherein said first recorded signal includes a sequence of time intervals, each of said time intervals containing a first perceptibly accented signal pulse followed by a pre-determined number of unaccented signal pulses.

17. The apparatus of claim 15 further including a display device for producing a visual display responsive to at least one of said first and second signals.

18. The apparatus of claim 15 wherein said first audible signal includes musical instrument percussion sounds.

19. The apparatus of claim 15 further including a third recorded, audible signal synchronized with said first recorded audible signal, said third recorded audible signal containing musical sounds.

20. The apparatus of claim 15 wherein at least one of said first and second signals includes a verbal instruction.

21. The apparatus of claim 15 wherein said second signal is cyclically repeated at a sub-harmonic of said first frequency.

22. The apparatus of claim 21 wherein said verbal instruction includes exercise initiation cues indicating the beginning of an exercise.

23. The apparatus of claim 22 wherein said verbal instruction includes a cyclically repeated sequence of exercise phase directions.

24. The apparatus of claim 23 wherein said verbal instruction includes exercise cessation signals indicating the completion of a pre-determined number of cyclically repeated phases of an exercise.

25. A method for pacing human physical exercises performed cyclically at an exercise cycle rate by stimulating a physiological response in a human being, said method comprising;

a. utilizing an audio playback device for playing back pre-recorded audio signals, said signals including,
   i. a first audible rhythm-setting clock signal emitted at a first frequency higher than an exercise cycle rate,
   ii. a second audible exercise phase cuing signal containing cues for pacing sequential phases of an exercise, said second signal being emitted at a second frequency synchronized with said first signal, and
   iii. said first and second signals being emitted simultaneously and independently of any external influence.

26. The method of claim 25 wherein said first audible signal is further defined as being cyclically repeated.

27. The method of claim 25 wherein said first frequency is constant.

28. The method of claim 25 wherein at least one of said first and second audible signals is accompanied by a visually perceptible signal.

29. The method of claim 25 wherein said first audible signal includes a sequence of time intervals, each of said intervals containing a first perceptibly accented signal pulse followed by a predetermined number of unaccented signal pulses.

30. The method of claim 25 wherein said first audible signal includes musical instrument percussion sounds.

31. The method of claim 30 further providing a third audible signal synchronously with said first audible signal, said third audible signal containing musical sounds.

32. The method of claim 25 wherein said second, audible cuing signal includes a verbal instruction.

33. The method of claim 32 wherein said second, audible cuing signal is cyclically repeated at a sub-harmonic of said first frequency.

34. The method of claim 32 wherein said verbal instruction includes exercise initiation cues indicating the beginning of an exercise.

35. The method of claim 34 wherein said verbal instruction includes a cyclically repeated sequence of exercise phase directions.

36. The method of claim 35 wherein said verbal instructions include exercise cessation signals indicating the completion of a pre-determined number of cyclically repeated phases of an exercise.

37. The method of claim 25 wherein said first frequency is higher than said second frequency.

38. The method of claim 37 wherein the first frequency is greater than one cycle per second.

* * * * *